United States Patent [19]

Tseng

[11] Patent Number: 4,867,627

[45] Date of Patent: Sep. 19, 1989

[54] MULTI-FLOOR ELEVATING PARKING STATION

[76] Inventor: Wen-Kung Tseng, No. 57, Chin Nian 2nd Rd., Kaohsiung, Taiwan, Taiwan

[21] Appl. No.: 180,905

[22] Filed: Apr. 13, 1988

[51] Int. Cl.[4] ..... E04H 6/22

[52] U.S. Cl. ..... 414/249; 187/8.59; 187/95; 188/32; 384/57; 384/58; 414/264

[58] Field of Search ..... 414/227, 228, 233, 242, 414/244, 247, 249, 264; 410/7–12, 19, 24, 26, 30; 187/8.59, 27, 95; 188/32, 62; 384/57, 55

[56] References Cited

U.S. PATENT DOCUMENTS

| | | | |
|---|---|---|---|
| 155,306 | 9/1874 | Hinkle | 187/27 |
| 628,828 | 7/1899 | Mentzer | 187/95 X |
| 665,758 | 1/1901 | Sayers | 187/95 X |
| 1,906,773 | 5/1933 | Scott | 414/233 X |
| 2,815,873 | 12/1957 | Moore | 414/249 |
| 3,802,579 | 4/1974 | Genest et al. | 414/249 |
| 4,434,876 | 3/1984 | McKechnie | 187/95 |
| 4,679,974 | 7/1987 | Blunden | 410/30 |

FOREIGN PATENT DOCUMENTS

| | | | |
|---|---|---|---|
| 1205669 | 11/1965 | Fed. Rep. of Germany | 187/95 |
| 571639 | 1/1958 | Italy | 414/249 |
| 579327 | 7/1958 | Italy | 414/249 |
| 644058 | 8/1962 | Italy | 414/249 |

*Primary Examiner*—David A. Bucci

*Attorney, Agent, or Firm*—Larson & Taylor

[57] ABSTRACT

A multi-floor elevating parking station constructed of a stable frame set under ground and containing a parking frame which is divided horizontally into a plurality of parking rooms or floors with steel plates. The parking frame can be raised up and down to make each floor or each parking room even with the ground surface so that a car can be parked in or driven out. Besides, the top steel plate of the parking frame can be used as a driveway when the parking frame is lowered down to the bottom of the stable frame.

7 Claims, 7 Drawing Sheets

MULTI-FLOOR ELEVATING PARKING STATION

BACKGROUND OF THE INVENTION

This invention concerns a multi-floor elevating parking station, which can park a large number of cars in a limited area of land.

Traditional ground parking lots have to leave a comparatively broad space of drive-ways for cars to go in and out there, and traditional multi-floor parking stations have been constructed as permanent buildings which not only take time in building but also are impossible to be moved to another spot. Obviously, such parking lots and stations generally need a rather spacious area of land, and can hardly be built in an irregular or long narrow area of land.

SUMMARY OF THE INVENTION

This multi-floor elevating parking station is constructed under the ground instead of on the ground. It comprises a stable frame made up of steel posts and steel beams connected between two posts, and a parking frame also made up of steel posts and steel beams and divided horizontally into a plurality of floors or parking rooms with steel plates. Said parking frame is contained inside said stable frame and can be raised up and down therein by means of motors and wire ropes. Said motors are set on the top of said stable frame and rotate shafts, on which one ends of the wire ropes are fixed, and the other ends of the wire ropes are fastened at the bottom of said parking frame. Therefore, said parking frame can be raised up or down by the wire ropes wound on the shafts by the motors so that each floor or parking room can be made even with the ground surface for parking in or driving out a car.

DETAILED DESCRIPTION OF THE INVENTION

Figure 1:
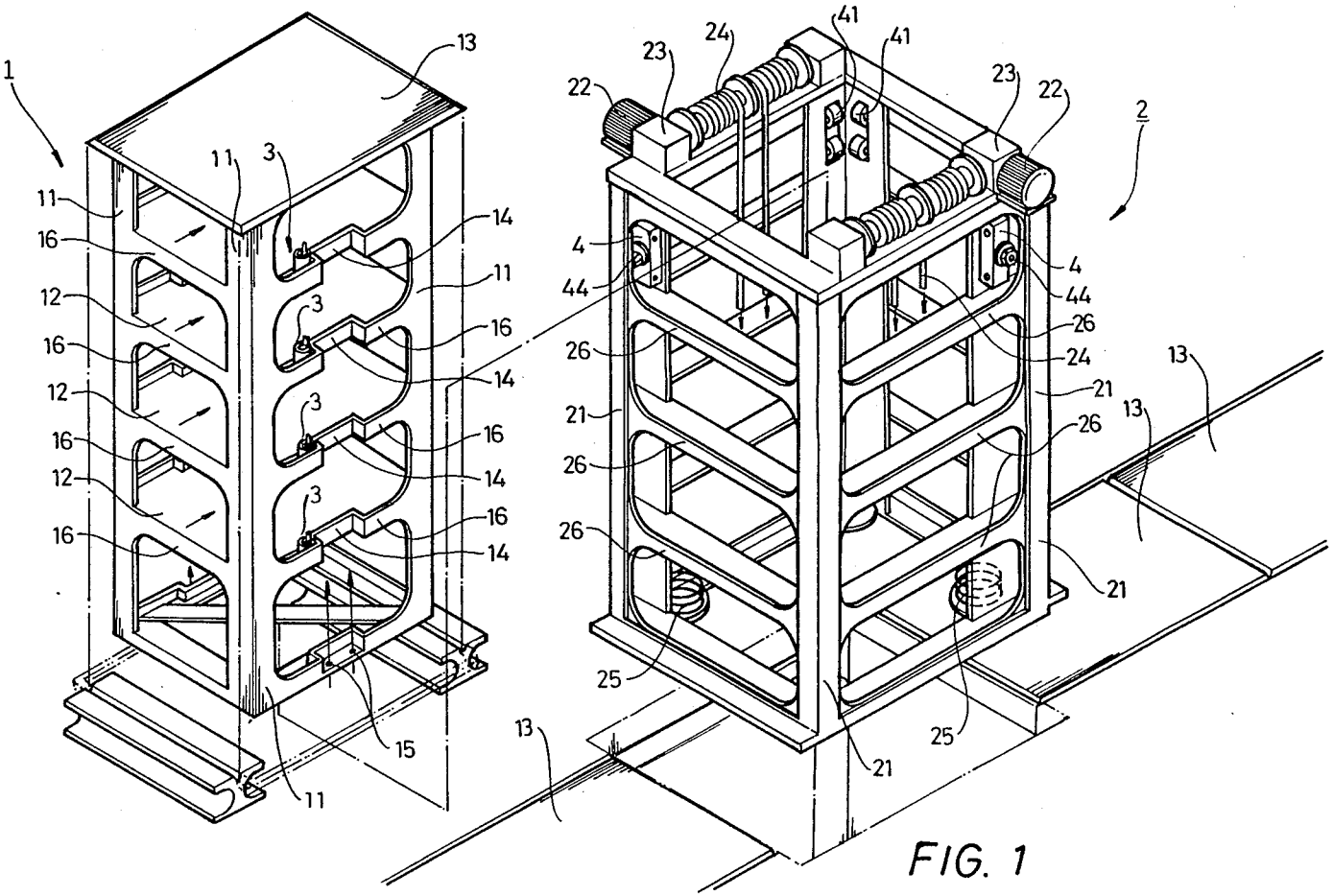
FIG. 1 is a view of the parking frame and the stable frame separated from each other in the multi-floor elevating parking station in accordance with the present invention.

FIG. 1 shows this multi-floor elevating parking station is constituted of a parking frame 1 and a stable frame 2 as the main parts, said parking frame 1 being contained inside said stable frame 2.

The parking frame 1 is an oblong vertical frame made up of steel posts 11 and horizontal beams 16 connected between two of said steel posts 11 at an equal distance, divided horizontally with steel plates 12 into a plurality of floors or parking rooms, on which a car can be parked separately moving in the arrow direction in the figures. There is a top steel plate 13 placed horizontally at the top of the parking frame 1 and the lowest room without a steel plate of the parking frame 1 cannot be used for parking. When the parking frame 1 is raised up to the highest position, said lowest room, impossible to be raised up the ground surface, is still kept within the stable frame 2 for maintaining the parking frame straight up safely. The two side horizontal beams 16 facing opposite to each other are provided separately with an inward recess 14 for two wire ropes 24 to pass by up and down. One ends of said wire ropes 24 are fastened at fastening holes 15 at the lowest beam 16. After a car moves in any of the floors, the right rear wheel and the left front wheel can be separately hampered by an anti-sliding bar 31 for preventing the car from sliding away as shown in FIG. 5.

Next, the stable frame 2 is also an oblong vertical frame made up of steel posts 21 and horizontal steel beams 26 connected between said posts 21 at an equal distance. Motors 22 separately set on the top two sides opposite to each other of said stable frame 2 combined with reducing gears 23 can revolve shafts which wind up and down wire ropes 24. The other one ends of said wire ropes 24 are fixed on said shafts (and the one ends at the fastening holes 15) so that the parking frame 1 can be raised up and down through the function of the wire ropes wound on the shafts rotated by said reduction gears 23 and said motors 22. There are buffer springs 25 set at each bottom corner of the stable frame 2 for receiving the parking frame 1 when it moves down for preventing both the frames 1 and 2 from vibration caused by their direct mutual touch.

Figure 4:
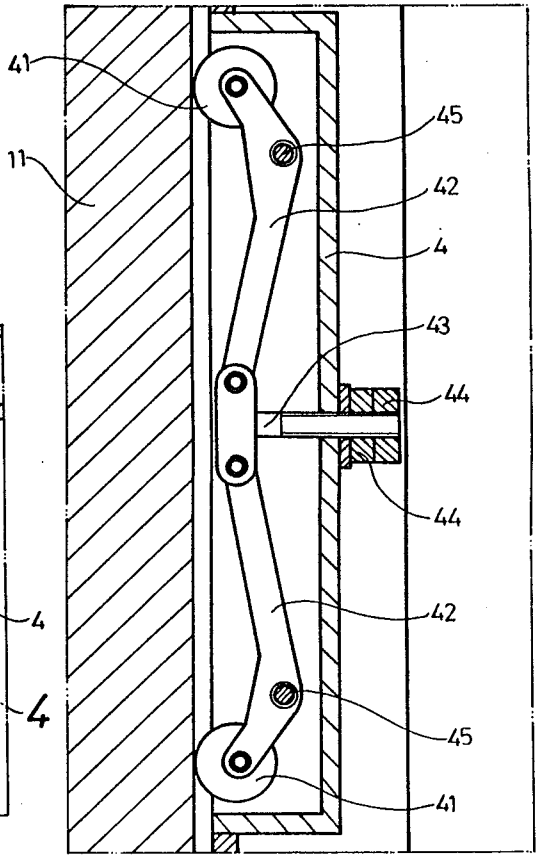
FIG. 4 is an enlarged view of the part marked 4 on FIG. 3.

In order to enable the parking frame 1 to rise up and down smoothly and steadily inside the stable frame 2, pulley sets 4 are separately provided at the inside surface of the upper part of the stable frame 2 as shown in FIGS. 1 and 4. Said pulley sets include two pulleys 41 set separately at one ends of two levers 42, the other ends of said levers 42 combined with a T-shaped bolt 43, said T-shaped bolt 43 protruding out of the cover of the pulley sets 4 and being screwed by a nut 44 at its end. Said levers 42 are pivotally set at their position with pivots 45 midway so that in case the nut 44 is screwed tightly against the T-shaped bolt 43, the levers 42 moved by the T-shaped bolt 43 can force the pulleys 41 to push against the vertical posts 11 of the parking frame 1 maintaining the up or down movement of said frame 1 smoothly operated.

Figure 5:
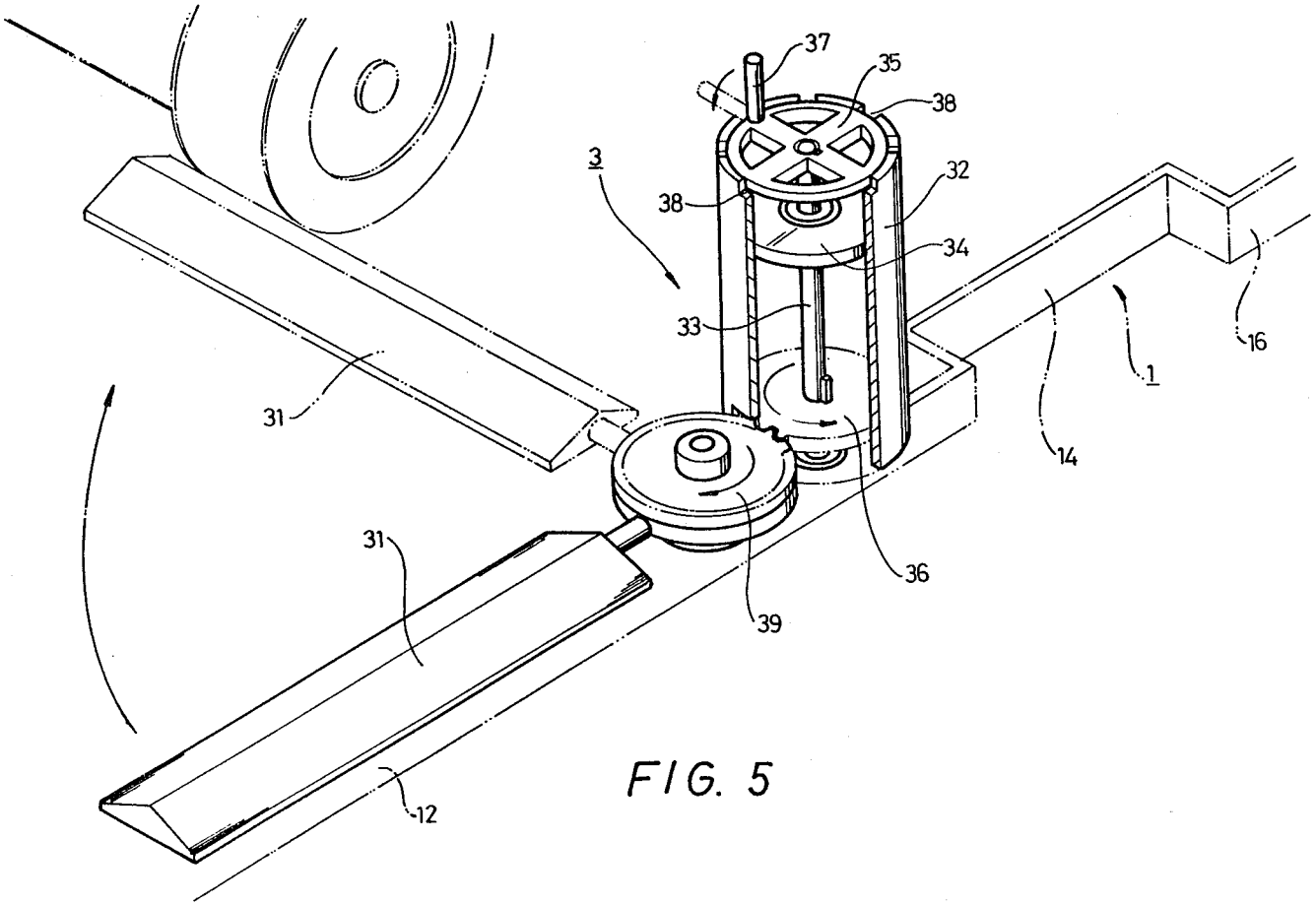
FIG. 5 is a view of the anti-slipping device in the multi-floor elevating parking station in accordance with the present invention.

The anti-sliding device 3 as shown in FIG. 5 is used for preventing a car from moving off the parked position after the car is parked on one of the floors. Said anti-sliding device 3 comprises a cylinder 32 and a shaft 33 contained vertically in said cylinder 32 and penetrating through the center of a stable disc 34 horizontally set in said cylinder 32, and a turning wheel 35 and a gear wheel 36 are separately fixed at the top end and the bottom end of the shaft 33. The turning wheel 35 is provided with a handle 37 which can be made to stand up for turning said wheel 35 or to lie down sticking in one of the notches 38 set around the top edge of the cylinder 32 to prevent said wheel 35 from rotating further. The gear wheel 36 engages with another gear wheel 39 which is welded together with the anti-sliding bar 31 so that said bar 31 can be turned for about 90 degrees crosswise to a car wheel when the gear wheel 39 is rotated by the turning wheel 35.

Figure 2:
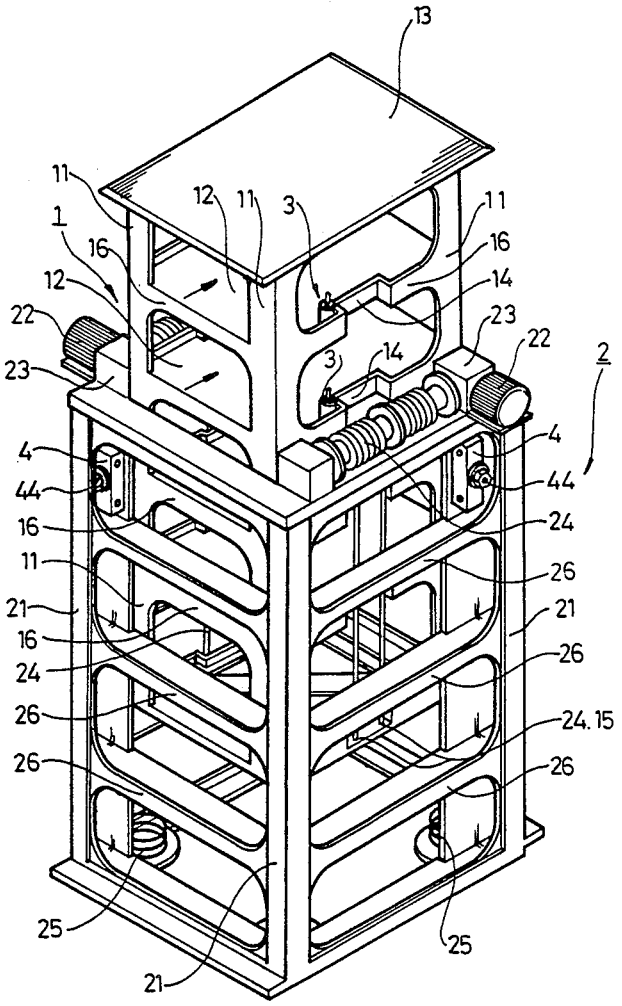
FIG. 2 is a schematic view of the multi-floor elevating parking station in accordance with the present invention.
Figure 3:
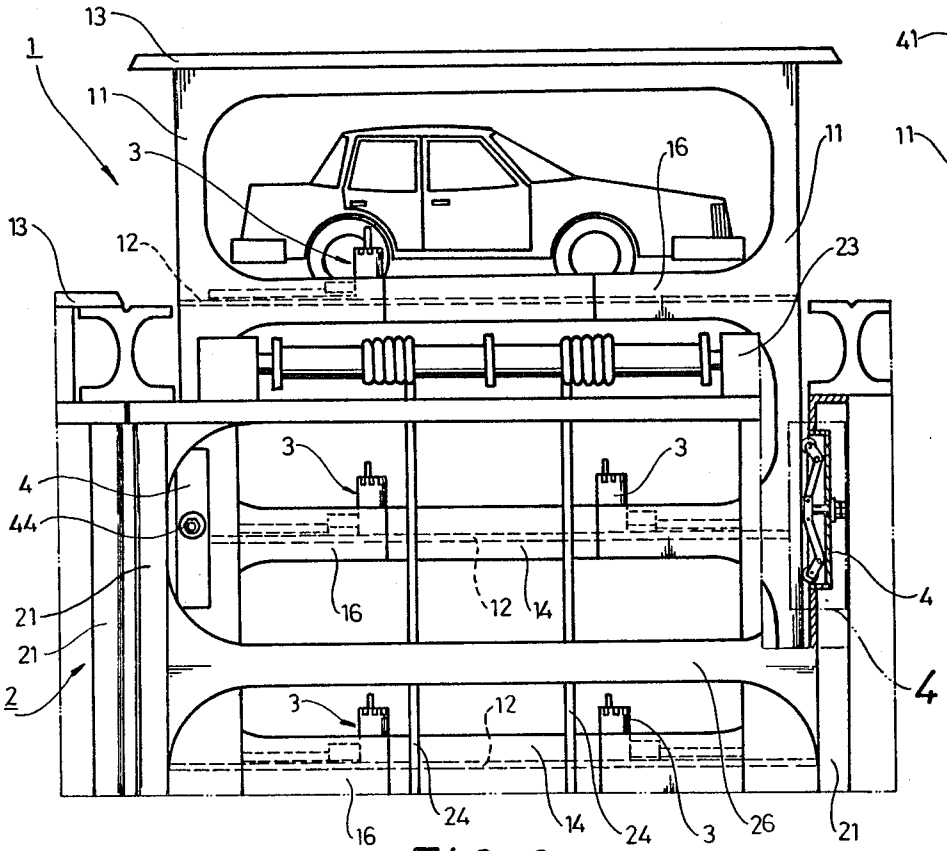
FIG. 3 is a side view of the multi-floor elevating parking station assembled together in accordance with the present invention.

Next, FIGS. 2 and 3 show a practical example of this parking station using only one parking frame 1 and one stable frame assembled together. Thus, when said parking frame 1 is pulled up to let one of the steel plates 1 or the floors become even with the ground surface, the car parked on said plate 1 can be driven out of the parking frame 1.

Figure 6:
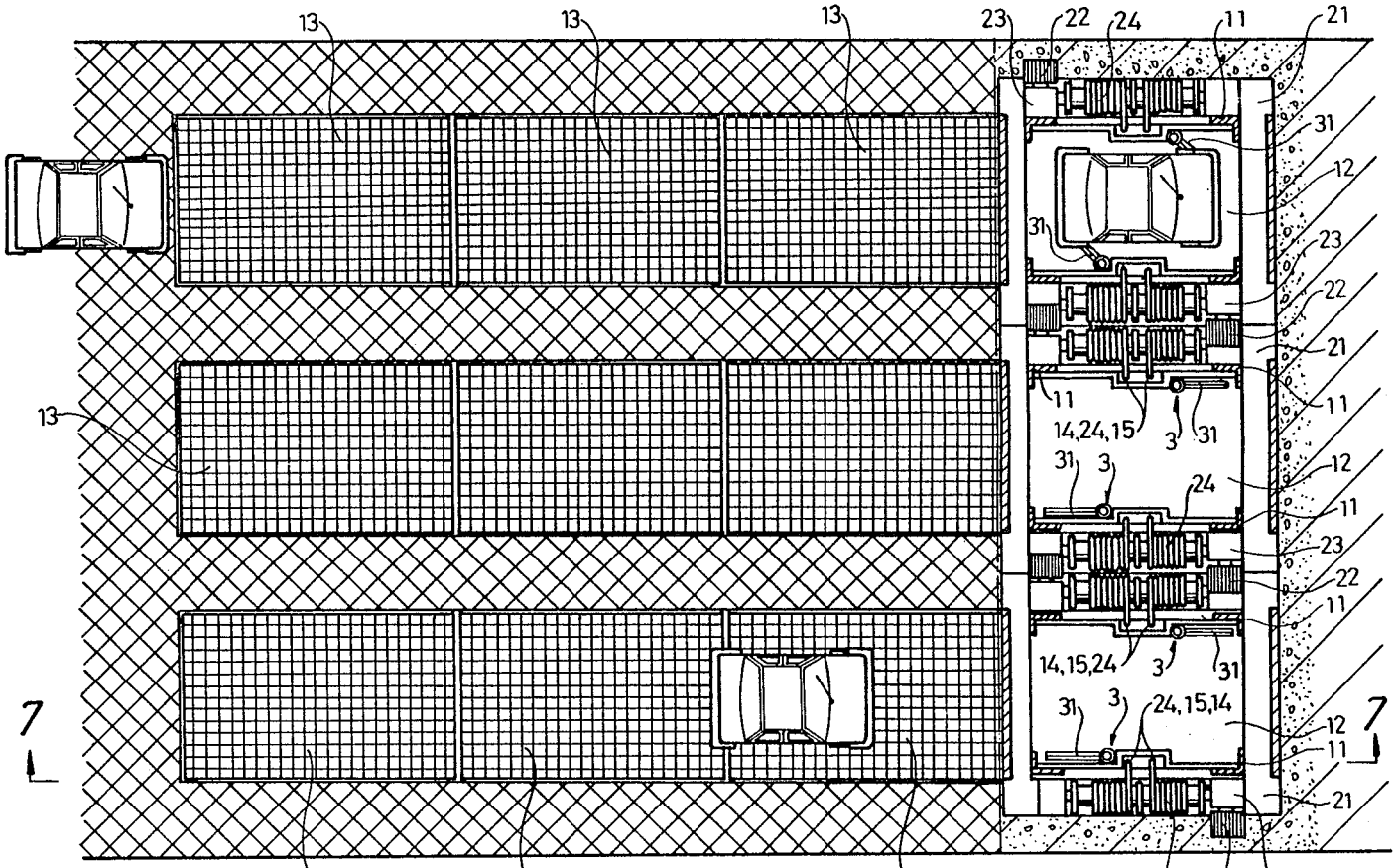
FIG. 6 is an upside view of the first practical example of the multi-floor elevating parking station in accordance with the present invention.

FIG. 6 shows a practical example of this parking station using a plurality of sets of the parking frames 1 and the stable frames continuously connected together. It is easily understood that both the frames 1 and 2 can be constructed connecting in the lateral or the lengthwise direction, and the empty spaces between the frames 2 are only needed to be filled in with concrete walls and the tops are only needed to be covered with steel plates. In this example each parking frame 1 is always contained and can be lowered down to the bottom in the stable frame 2 and then all of the top plates 13 of the parking frames 1 make up a drive-way for cars to park in or to drive out of the station. Only one of the parking frames 1 where a car is to be parked in or to be driven out should be raised up to the level of the ground, and the car can be parked therein with the handles 37 of the anti-sliding device 3 operated to stop the car wheels or driven out there with said device 3 operated to make the anti-sliding bars 31 to leave off the car wheels.

Figure 8:
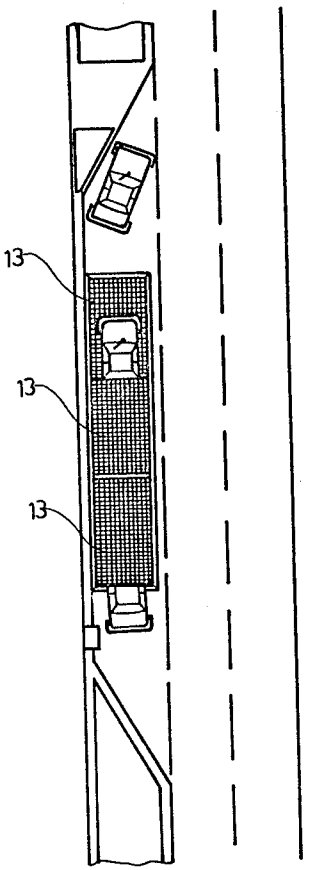
FIG. 8 is an upside view of the second practical example of the multi-floor elevating parking station in accordance with the present invention.

FIG. 8 shows this parking station is constructed in the traffic island, making use of the narrow long characteristic of the land for solving the parking problem.

Figure 9:
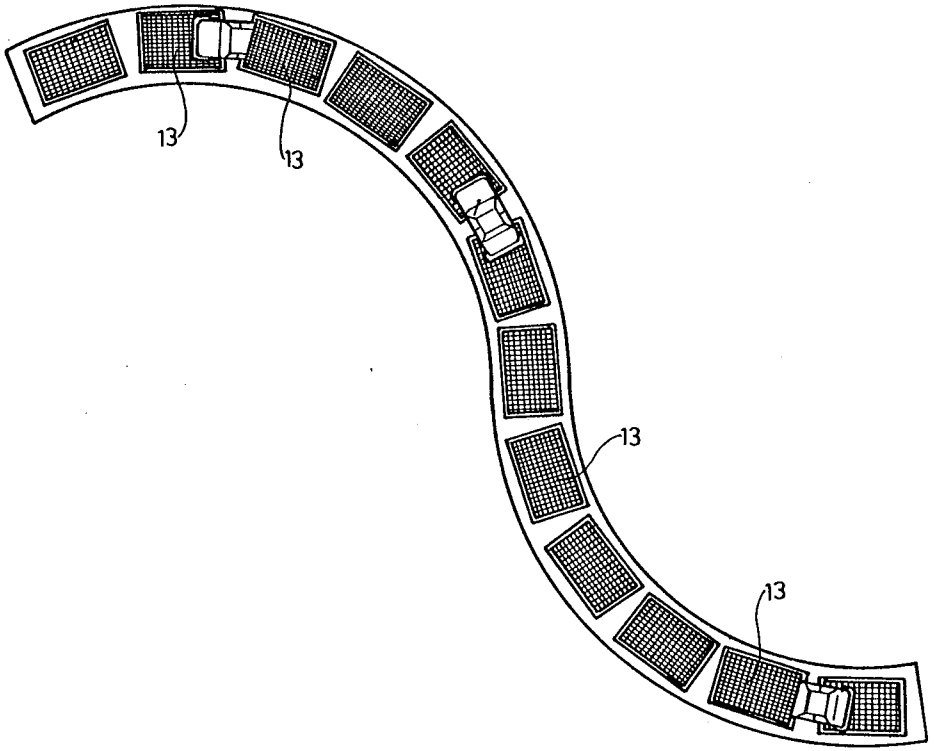
FIG. 9 is an upside view of the third practical example of the multi-floor elevating parking station in accordance with the present invention.

Besides, FIG. 9 shows that this parking station is constructed in a land of irregular shape for solving the parking problem, too.

Figure 7:
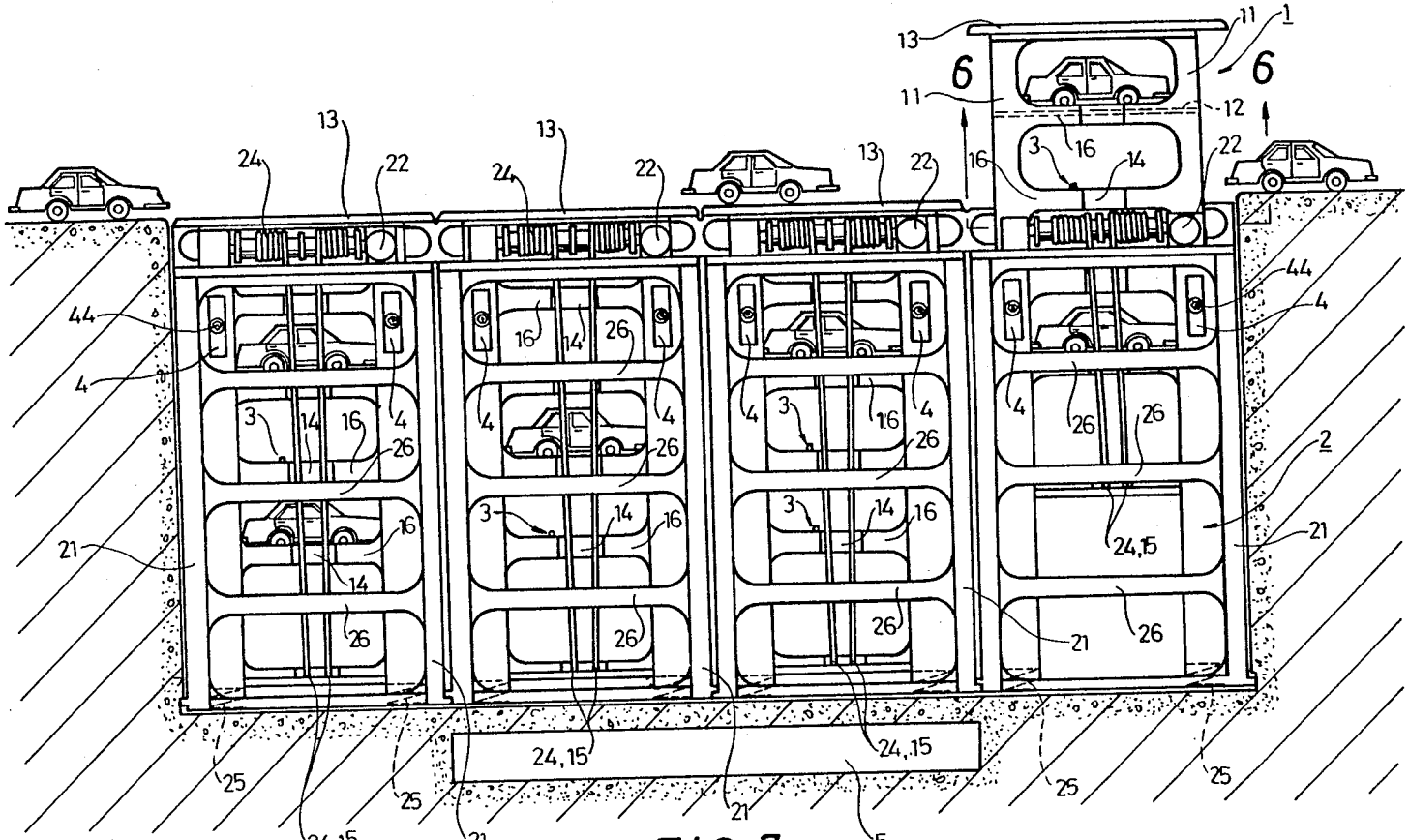
FIG. 7 is a cross-sectional view taken along line 7—7 of FIG. 6.

As this parking station is to be constructed under the ground as shown in FIG. 7, a water pool 5 must be provided at the bottom for collecting rain falling therein and a water pump can be used to pump out the water collected in said pool 5. In case of a flood that the pump can not manage, the whole frame 1 can be raised up lest the cars parked therein be flooded in.

In general, this parking station in accordance with the present invention has a main feature that no drive-way is necessary for a car to drive in or out this station, as the top plates not only make up a drive-way but serve for cars to park thereon, and a driver does not have to walk a far way for parking in or driving out. Therefore, a piece of land can be utilized as much as possible in parking cars if this parking station is used. The swift movability of cars can be attained, and the steel frames can be moved to another spot by taking to pieces without breaking to change the use of the land.

What is claimed is:

1. A multi-floor elevating parking station comprising:

a parking frame and a stable frame, (a) said parking frame and said stable frame both being made of steel posts and steel beams connected between two of said posts, (b) said stable frame being located beneath a ground surface and containing said parking frame therein, and (c) said parking frame including steel floor plates which divide said parking frame horizontally into a plurality of parking rooms;

two motor means provided at a top of said stable frame which are operatively connected to wire ropes fixed to a bottom of said parking frame for raising up and down said parking frame in said stable frame so that each floor plate is selectively movable to a position even with the ground surface for parking in and driving out of a car relative to the selected floor plate; and pulley sets provided on said stable frame for guiding the movement of said parking frame, each said pulley set including (a) a cover having a vertical wall with a hole therein, said vertical wall disposed relative to said parking frame to have a facing side and a non-facing side, (b) a T-shaped bolt having a leg which projects horizontally through the hole in said vertical wall of said cover and a cross member which is located on the facing side of said vertical wall of said cover and which is vertically disposed, (c) a nut which is received on a free end of said leg of said T-shaped bolt and which is located adjacent said non-facing side of said vertical wall of said cover, (d) two levers having proximal and distal ends, respective said proximal ends of said levers being attached to a respective end of said cross member of said T-shaped bolt such that said levers extend vertically and in opposite directions, (e) a respective pivot means provided intermediate the ends of each said lever such that horizontal movement of said leg of said T-shaped bolt causes said distal ends of said levers to move, and (f) a respective pulley located at each distal end of said levers which engages said parking frame, the engagement of said pulleys being adjusted by rotation of said nut on said leg of said T-shaped bolt.

2. The multi-floor elevating parking station as claimed in claim 1, wherein the parking frame has a top covered with a flat top steel plate, said top steel plate making up a driveway when said parking frame is lowered down to a bottom of the stable frame.

3. The multi-floor elevating parking station as claimed in claim 1, wherein the parking frame has a lowest floor without a floor steel plate, said lowest floor still remaining in the stable frame and never going above the ground surface even if the parking frame is raised up to a highest position.

4. A multi-floor elevating parking station comprising:

a parking frame and a stable frame, (a) said parking frame and said stable frame both being made of steel posts and steel beams connected between two of said posts, (b) said stable frame being located beneath a ground surface and containing said parking frame therein, and (c) said parking frame including steel floor plates which divide said parking frame horizontally into a plurality of parking rooms;

two motor means provided at a top of said stable frame which are operatively connected to wire ropes fixed to a bottom of said parking frame for raising up and down said parking frame in said stable frame so that each floor plate is selectively movable to a position even with the ground surface for parking in and driving out of a car relative to the selected floor plate; and respective anti-slidding means for each said steel plate for stopping a car wheel of a car located on an associated steel plate, each said anti-slidding means including (a) a round cylinder attached to said steel plate, said cylinder having a longitudinal axis which is vertical and an upper circumferential edge in which notches are provided, (b) a turning wheel provided in said cylinder adjacent said upper edge, said turning wheel including a handle which is movable from a vertical position for turning said turning wheel to a horizontal position where said handle is received in one of said notches, (c) a first gear wheel provided in said cylinder adjacent a lower edge thereof, (d) a stable disc mounted in said cylinder, (e) a shaft which is rotatably mounted by said stable disc along the longitudinal axis of said cylinder and which is attached to said turning wheel and said first gear wheel whereby rotation of said turning wheel by said handle causes rotation of said first gear wheel, (f) a second gear wheel which is mounted for rotation in a horizontal plane and for engagement with said first gear wheel, and (g) an anti-slidding bar attached at one end to said second gear wheel and extending horizontally therefrom such that by rotation of said turning wheel with said handle, said anti-slidding bar is movable between a position where said anti-slidding bar engages the wheel of the car and is locked against movement by positioning said handle in one of said notches and a position where said anti-slidding bar is out of engagement with the wheel.

5. The multi-floor elevating parking station as claimed in claim 4, wherein the parking frame has a top covered with a flat top steel plate, said top steel plate making up a driveway when said parking frame is lowered down to a bottom of the stable frame.

6. The multi-floor elevating parking station as claimed in claim 4, wherein the parking frame has a lowest floor without a floor steel plate, said lowest floor still remaining in the stable frame and never going above the ground surface even if the parking frame is raised up to a highest position.

7. The multi-floor elevating parking station as claimed in claim 4 and further including pulley sets provided on said stable frame for guiding the movement of said parking frame, each said pulley set including (a) a cover having a vertical wall with a hole therein, said vertical wall disposed relative to said parking frame to have a facing side and a non-facing side, (b) a T-shaped bolt having a leg which projects horizontally through the hole in said vertical wall of said cover and a cross member which is located on the facing side of said vertical wall of said cover and which is vertically disposed, (c) a nut which is received on a free end of said leg of said T-shaped bolt and which is located adjacent said non-facing side of said vertical wall of said cover, (d) two levers having proximal and distal ends, respective said proximal ends of said levers being attached to a respective end of said cross member of said T-shaped bolt such that said levers extend vertically and in opposite directions, (e) a respective pivot means provided intermediate the ends of each said lever such that horizontal movement of said leg of said T-shaped bolt causes said distal ends of said levers to move, and (f) a respective pulley located at each distal end of said levers which engages said parking frame, the engagement of said pulleys being adjusted by rotation of said nut on said leg of said T-shaped bolt.

* * * * *